United States Patent [19]

Masiello

[11] 3,952,465

[45] Apr. 27, 1976

[54] BUILDING STRUCTURE FORMED OF MODULAR UNITS WITH CANTILEVERED PORTIONS FOR FORMING A CORRIDOR FLOOR

[75] Inventor: Dominic J. Masiello, Rochester, N.Y.

[73] Assignees: Dominic Joseph Masiello; Louise A. Masiello, both of Rochester, N.Y.

[22] Filed: Mar. 19, 1971

[21] Appl. No.: 125,939

[52] U.S. Cl. ..... 52/73; 52/79; 52/234; 52/236

[51] Int. Cl.[2] ..... E04B 1/348

[58] Field of Search ..... 52/79, 234, 236, 73

[56] References Cited

UNITED STATES PATENTS

| | | | |
|---|---|---|---|
| 1,886,962 | 11/1932 | Roche | 52/79 |
| 2,419,319 | 4/1947 | Lankton | 52/79 |
| 3,201,907 | 8/1965 | Henderson | 52/79 |
| 3,287,865 | 11/1966 | Lockman | 52/79 |
| 3,292,327 | 12/1966 | Van Der Lely | 52/79 |
| 3,377,755 | 4/1968 | Stucky et al. | 52/79 |
| 3,510,997 | 5/1970 | Ratych | 52/79 |
| 3,564,787 | 2/1971 | Sherman | 52/79 |
| 3,568,380 | 3/1971 | Stucky | 52/79 |
| 3,601,521 | 8/1971 | Morton | 52/79 |
| 3,605,354 | 9/1971 | Hodgetts | 52/73 |
| 3,678,637 | 7/1972 | Klipfel | 52/79 |

FOREIGN PATENTS OR APPLICATIONS

| | | | |
|---|---|---|---|
| 431,912 | 9/1967 | Switzerland | 52/236 |
| 1,329,921 | 5/1963 | France | 52/236 |
| 385,131 | 3/1965 | Switzerland | 52/79 |

OTHER PUBLICATIONS

Popular Mechanics Magazine, June 1951, Vol. 95, p. 126.

The New Building Block, TH1098.N4, Copyright 1968, Klein, pp. 198–203.

*Primary Examiner*—Frank L. Abbott
*Assistant Examiner*—Leslie A. Braun
*Attorney, Agent, or Firm*—Stonebraker, Shepard & Stephens

[57] ABSTRACT

A building constructed mainly of a series of modular units permanently united to each other. Various different forms of units are provided, and units of different forms may be arranged in various different relations to each other, to provide a choice of floor plans. Each unit is a rigid structure having a floor slab portion and one or more wall portions integrally connected to the floor slab portion and rising to the full height of the story, at least some of the wall portions of most of the units being offset laterally inwardly from the edges of the floor slab portion. When various units of the same story are assembled in side by side relation, the wall portion or portions of one unit cooperate with the wall portion or portions of one or more additional units to provide an enclosure constituting a room. The floor slab portions of the next higher story rest on the top edges of the wall portions of the story immediately below. A suitable roof structure is provided over the assembled units, and various special or supplementary units are used to provide stairs, hallways, or other special situations. Appropriate plumbing fixtures and kitchen appliances are preferably installed in the modular units at the factory where the units are made, in such a way that only a few connections need be completed at the building site when the units are assembled to make the habitable building structure, in order to put the plumbing and kitchen equipment into fully operational condition.

1 Claim, 8 Drawing Figures

FIG. 7
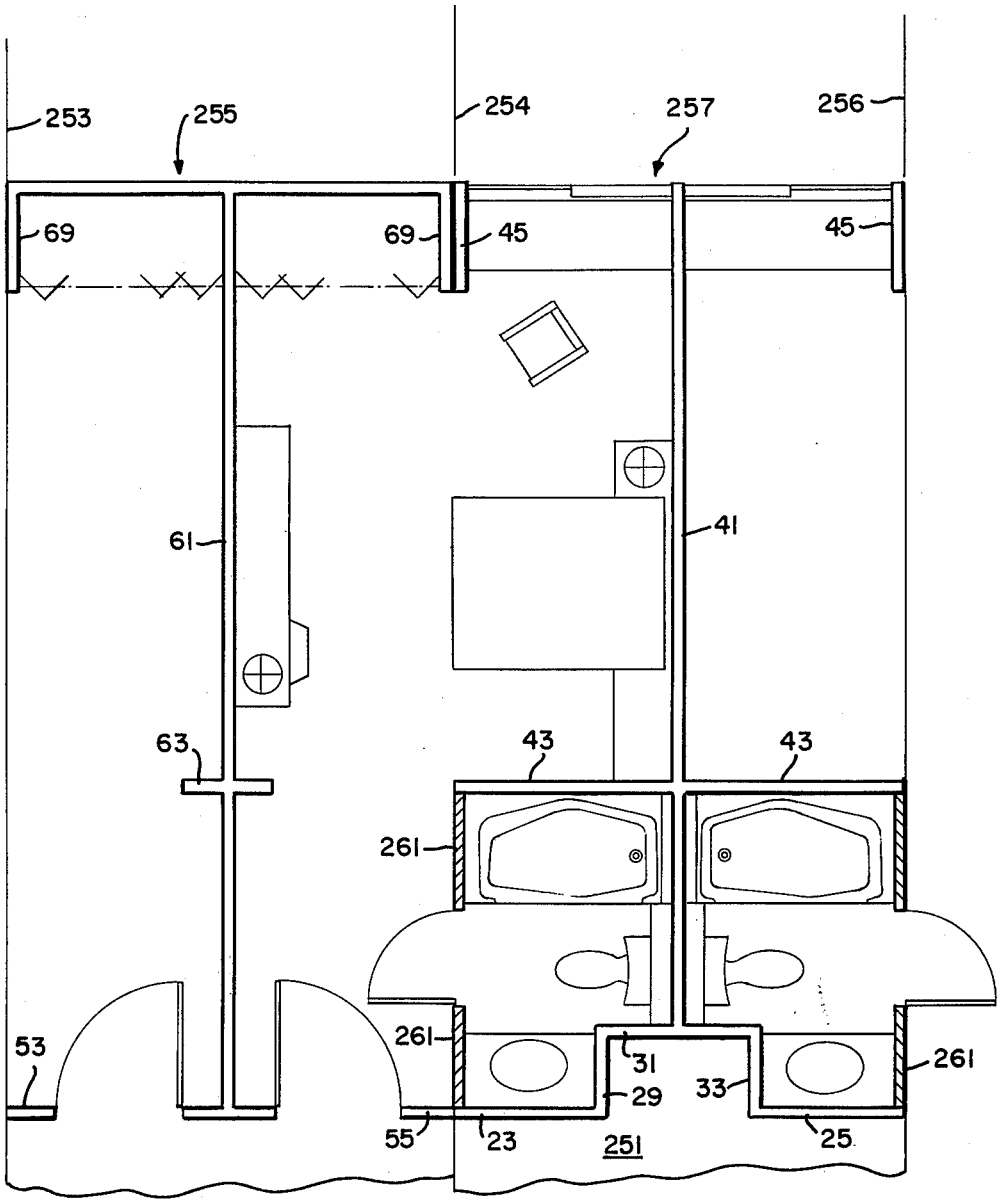
FIG. 8
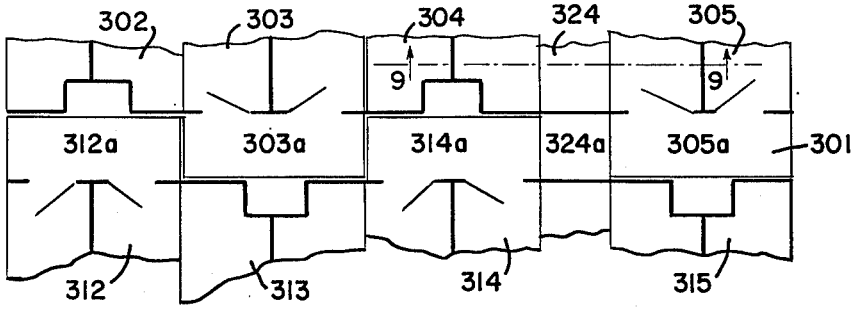
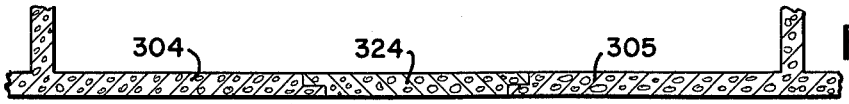
FIG. 9

BUILDING STRUCTURE FORMED OF MODULAR UNITS WITH CANTILEVERED PORTIONS FOR FORMING A CORRIDOR FLOOR

BACKGROUND OF THE INVENTION

In recent years, many attempts have been made to construct buildings from a plurality of modular units. Examples of some of the proposed constructions are disclosed in U.S. Pat. Nos. 2,698,973 of Jan. 11, 1955; 3,201,907 of Aug. 24, 1965; 3,292,327 of Dec. 20, 1966; 3,377,755 of Apr. 16, 1968; 3,510,997 of May 12, 1970; and 3,514,910 of June 2, 1970. Other patents on modular building constructions exist, but those above mentioned are fairly typical.

The constructions shown in these patents have not gone into any widespread use. In spite of the fact that there appears to be a great demand for a comparatively economical way of constructing habitable buildings, the defects and disadvantages of the prior patented constructions have been so great that they have not become popular.

An object of the present invention is to provide modular units of a more practical and economically feasible design, overcoming the disadvantages of the prior art.

Another object is the provision of modular housing units so designed as to be light enough and particularly to have sufficient strength and rigidity for safe, speedy, and practical handling both in transportation and in erection at the final building site.

Still another object of the invention is the provision of a modular construction so designed that plumbing fixtures, cooking equipment, and other major appliances may, if desired, be installed at the factory where the modular unit is made, in such a way that they may be safely transported as part of the modular unit during the trip from the factory to the erection site, with no appreciable danger to the pre-installed equipment or appliances, and will require only a minimum of simple hook-up operations when the modular units are erected.

A further object is the provision of modular units so designed that essentially the same units may be used in constructing a variety of habitable buildings, such for example as apartment houses of multiple stories containing apartments of various sizes, hotels or motels of single or multiple stories, economy type apartments for elderly people, town houses, dormitories, hospitals, nursing homes, and the like, the same basic modular unit design being used for the majority of the units in each of the above mentioned types of buildings, with minor variations depending upon which type of building is to be constructed.

A still further object is the provision of a modular housing unit so designed as to have relatively great strength and rigidity in proportion to its floor area and its cubic content.

BRIEF DESCRIPTION OF THE DRAWINGS

FIG. 7 is a partial schematic floor plan showing how various modular units can be combined to provide rooms suitable for a hotel or motel;

FIG. 8 is a fragmentary schematic plan showing how the floor slabs of certain modular units may be extended to form the floor of a corridor; and FIG. 9 is a fragmentary vertical section taken transversely through portions of two adjacent modular units with a supplementary floor slab between them.

DESCRIPTION OF THE PREFERRED EMBODIMENT

Figure 1:
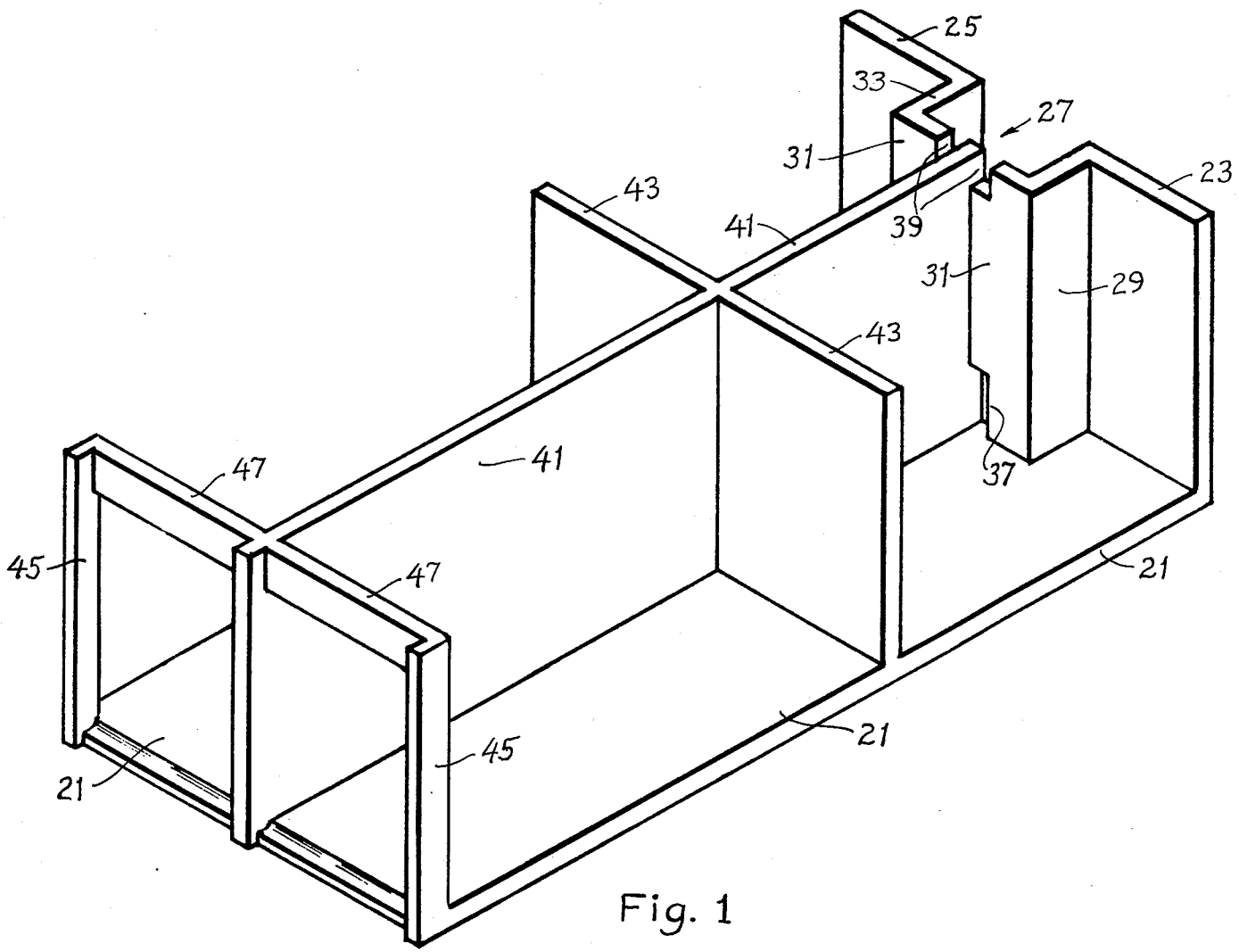
FIG. 1 is a simplified schematic isometric view of one form of modular unit according to the present invention, which may be designated for identification as unit A.

The modular units according to the present invention are units of two or more kinds or styles, intended to be used in conjunction with each other to form a habitable building structure. Unlike many of the modular building units disclosed in many of the prior patents, no single unit according to the present invention is intended to encompass the entire area of any one room. In each case, the area of any one room will be formed partly from the area of one modular unit and partly from the area of another modular unit adjacent to it. This statement applies to main rooms of the finished building, such as bedrooms or living rooms. It does not apply to small rooms such as kitchenettes or bathrooms, which conveniently are formed entirely within a single modular unit. But in the main rooms (bedrooms and living rooms) there will be a joint (covered over and invisible to the occupant) running through the room, where two adjacent modular units were joined to each other side by side, this joint conveniently running along or approximately along the centerline of the room.

Briefly summarized, each modular unit according to the present invention comprises a rectangular floor slab having a length appropriate to extend from a corridor or hallway in a building to an outer wall of the building parallel to the corridor, and having a width somewhat less than its length. Walls or at least partial walls rise upwardly from the floor slab at its two ends, and a partition wall extends longitudinally along the floor slab, in a position set materially inwardly from both of the side edges of the floor slab, the partition wall running preferably along the center line of the modular unit, in a longitudinal direction. The partition wall may or may not have doorway openings through it, depending upon the desired floor plan of the building to be built from the modular units. The lateral edges of each floor slab (that is, the side edges which extend in a direction longitudinally of the floor slab, perpendicular to the corridor and the outer wall above mentioned) are open and free of any walls except for small wall sections which may be provided at some of the corners of the structure. All of the above mentioned walls rise through the full height of the story, the upper edges of the walls forming bearing surfaces on which the next higher modular unit rests, if the building has more than one story. No roof is provided as part of the modular unit, but of course a roof is provided separately, as a separate element of the complete building.

This construction, having the characteristics or features above mentioned, enables the modular units of the present invention to be of relatively light weight, yet very strong and rigid, sufficient to withstand rapid mechanized loading at the factory site onto suitable carriers such as railroad cars or large highway trucks, and to withstand the jolts and jars of transportation on such trucks or cars through great distances, and to withstand the handling incident to unloading them at the erection site and erecting them to form either a single story or multi-story building. The strength and rigidity result in large part from the above described features, since each unit in transverse cross section has approximately the shape of the inverted letter T, the floor slab constituting the cross bar of the T and the longitudinal partition, spaced inwardly from both side edges of the floor slab, constituting the central vertical member of the letter T and acting as a stiffening rib to give great rigidity to the modular unit against flexure in its longitudinal direction even when the floor slab is supported only at its four corners or only at some intermediate support with the ends overhanging, both of which conditions may occur a number of times in practice during the loading, unloading, and erecting process.

The floor slab of each unit together with the wall portions rising therefrom are of reinforced concrete or the like, integrally formed to constitute a single rigid unit. Such a unit can be economically constructed in a factory, using modern mass production techniques, more economically than a similar structure could be built at the building erection site. When the floor slab and integral wall portions rising therefrom have been completed, desired fixtures and appliances may then be installed on the floor or the wall or both, at the same factory, complete with water pipes, sewer pipes, electrical connections, etc., more efficiently and economically than is possible at the building site. Only a few final connections of pipes, electrical wiring, etc., need be made at the building site when the various modular units are assembled to make the building structure. Thus bathtubs, washbasins, water closets, kitchen cooking equipment, refrigerators, etc., may all be installed in their desired final locations in the modular unit, and be transported to the building site as part of the unit, requiring only a relatively simple final hookup at the building site. The floor slab and the wall portions rising therefrom will adequately protect the installed plumbing fixtures, cooking equipment, etc., during transportation of the modular unit by truck or railroad car, so that there is no danger of damage to the installed equipment during transportation.

Referring now to the drawings, FIG. 1 shows in simplified perspective or isometric view, the main features of one form of modular unit which may be identified as unit A. It comprises a rigid floor slab portion 21 of rectangular plan, having a length sufficient to reach from a hall or corridor to an outer wall parallel to such corridor, and an appropriate width of a size to give the unit as much area as possible and yet permit it to be handled by available transportation equipment, such as highway trucks or railroad cars. The length of the unit, in a direction perpendicular to the hallway or corridor at one end of the unit, is ordinarily substantially greater than the width of the unit, in a direction parallel to the corridor. Conveniently, the width of this unit A may be approximately 12 feet, and the length thereof may be approximately 27 feet. These dimensions, and all other dimensions given in this application, are intended merely as illustrative examples of satisfactory dimensions, and are not intended to be interpreted in a limiting sense or as critical dimensions.

At the end of the floor slab which is adjacent the hallway or corridor in the finished building, there are end wall sections 23 and 25 which extend from the corners inwardly toward the longitudinal center line of the unit, each through a distance of about 3 feet, leaving a gap of about 3 feet between these two wall sections 23 and 25, as plainly seen in FIG. 1, where the gap is indicated at 27. This gap 27 is open at what may be called the corridor side, and is boxed in on the other three sides by wall sections 29, 31, and 33, arranged as shown, joining the walls 23 and 25 as illustrated. Assuming for the sake of example that the unit is 9 feet wide and that each wall section 23 and 25 is 3 feet long, the open space 27 will be approximately 3 feet less the thickness of the two wall sections 29 and 33. The recess 27 may extend into the structure (that is, in a direction toward the opposite or outer wall end of the unit) for a suitable distance such as about 2 feet. The floor slab 21 is correspondingly shaped; that is, there is no floor to the recess portion 27. Thus when one modular unit of this kind is stacked on top of a similar modular unit in erecting a multi-story building, the recesses 27 of the various modular units line up with one another and constitute a shaftway extending from top to bottom of the building, wherein vertically extending soil pipes, vent pipes, water pipes, electric conduits, gas pipes, or other utility supplies may be installed. Branches taken off of the utility supplies at appropriate points connect with the pre-installed piping or conduits of bathroom and kitchen fixtures, which come out into the shaftway space 27, passing for example through suitable notches 37 and 39 in the wall 31.

A wall section 41 extends longitudinally along the modular unit through substantially the entire length thereof, from the shaftway wall 31 to the far end or outer wall end of the modular unit. It will be noted from FIG. 1 that this wall 41 is set substantially inwardly from both of the lateral edges or side edges of the floor slab 21. Preferably the wall 41 extends along the longitudinal center line of the unit, midway between the lateral edges, but it is not necessarily in exactly this position, for it could be set somewhat to one side or the other of the center line.

At a suitable distance in a longitudinal direction along the unit, preferably about 10 feet from the wall sections 23 and 25, is a transverse wall or partition 43, extending in opposite directions from the longitudinal wall 41 to the extreme lateral edges of the floor slab, as shown. One or both portions of the transverse wall 43 (that is, on one or both sides of the longitudinal wall 41) may be provided with a doorway opening if desired, although in the preferred form of construction the wall 43 is solid throughout the entire width of the modular unit, and has no door openings therein.

At what may be called the outer end or far end of the unit (thinking of the corridor end, where the wall sections 23 and 25 are located, as the near end) there are rather short walls 45, extending from the corners of the unit inwardly toward the opposite or corridor end of the unit, through a horizontal distance of only about 1 foot. Thus there is quite a large gap of some 14 or 15 feet between the wall section 45 and the transverse wall 43, and throughout this gap there is no wall along the lateral edge of the unit. The top of each wall section 45 is connected to the longitudinal wall 41 by a strengthening or stiffening web or beam section 47 as illustrated, preferably set slightly inwardly from the extreme end of the structure. When the unit is erected along with other modular units to form a building, the openings between the wall sections 45 and the central or longitudinal wall 41, from the floor slab 21 to the upper beams 47, may be provided with suitable window assemblies set into these openings, or with door assemblies giving access to a patio, if the unit is at ground level, or to a balcony, if the unit is part of a higher story.

As already indicated, the floor slab and all of the wall sections and beam sections above mentioned are preferably integrally cast as a single integral rigid unit of reinforced concrete or the like. Dimensions may be varied as desired. Conveniently the floor slab 21 and the longitudinal wall 41 each have a thickness of about 5 inches, and likewise the wall sections 23, 25, 31, and 45, and the strengthening webs 47, may have a thickness of about 5 inches, while the transverse wall or partition 43 may have a thickness of about 4 inches. All of the wall sections rise to the same height (except for notches such as shown at 39), extending through the full height of the story, such height being for example about 8 feet or 8½ feet above the top surface of the floor slab 21. The top edges of all of these wall sections constitute flat surfaces in a common horizontal plane, and are adapted to form a support for a similar modular unit resting on top of the first unit, with the flat bottom surface of the floor slab 21 of the higher unit resting on the top edges of the wall sections of the unit below it. Suitable anchoring means, not shown, are provided for anchoring one unit to another. Also some of the steel reinforcing rods in the central longitudinal partition or wall 41 may extend upwardly a little above the top edge of this wall and be bent over in inverted U-shape and then extend downwardly again into the wall, these portions constituting loops to be engaged by hooks of a crane or hoist used in loading and unloading the unit on transportation vehicles, and in erecting the various units to form the completed building. If such loops are used, then the bottom surface of the floor slab is provided with corresponding recesses so that when one modular unit is placed on the other, there will be recesses in the floor slab of the upper unit to receive the looped reinforcing bars which extend above the top of the wall portion of the lower unit. Lifting loops may also be imbedded in appropriate locations in the floor slab, placed initially in recesses which will later be filled with concrete upon completion of erection.

Figure 2:
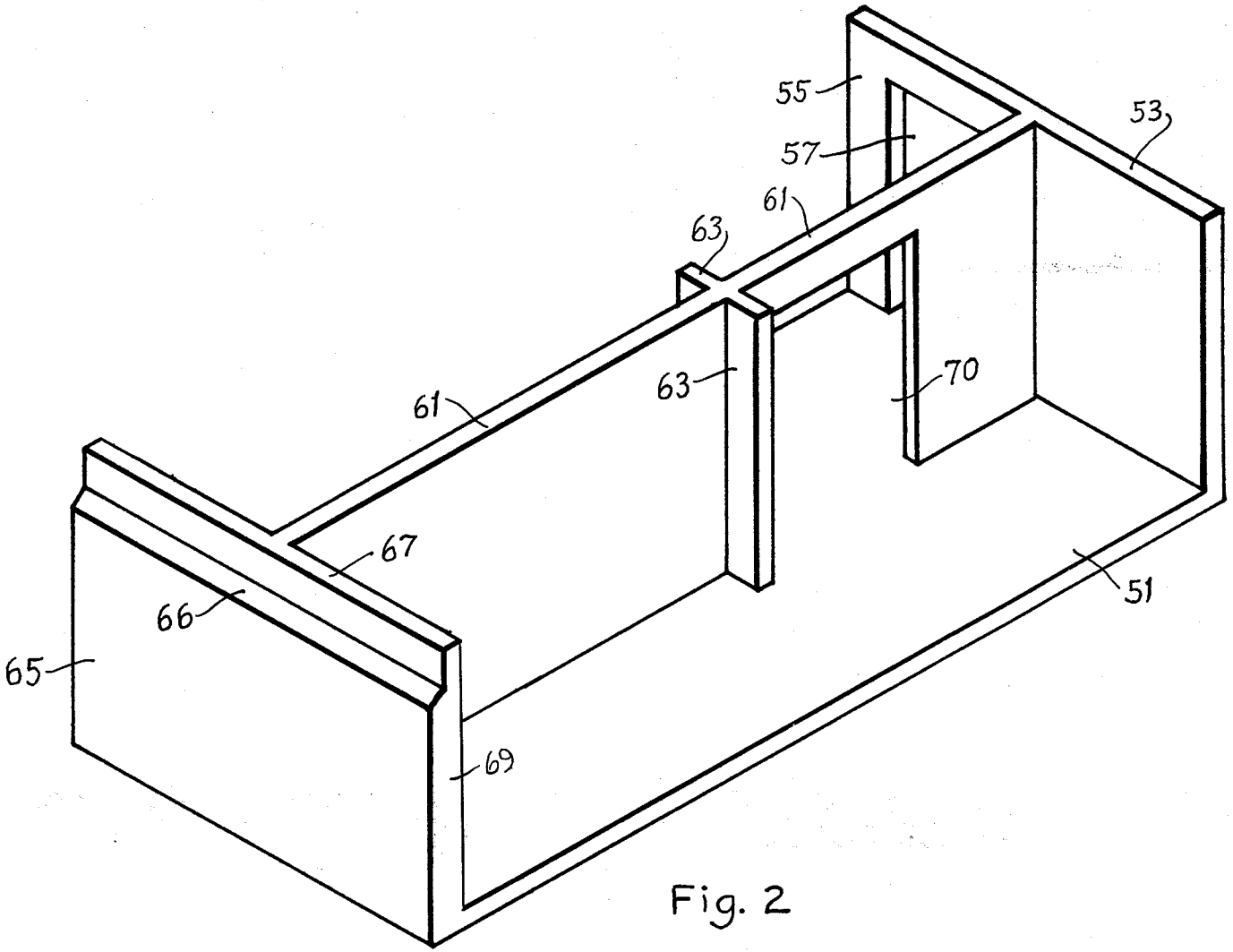
FIG. 2 is a similar view of a different form of unit which may be identified as unit B.

A second kind or style of modular unit, conveniently referred to as unit B, is used in conjunction with unit A to form the complete rooms. A typical preferred embodiment of unit B, in somewhat simplified schematic form, is shown in FIG. 2. It has a floor slab 51 of the same dimensions as the floor slab of unit A, except that it does not have the cut-out notch at the corridor end, since there is no shaftway in the B unit.

At the corridor end of the unit, there are vertical wall sections 53 and 55, one of which may have a doorway opening such as shown at 57 in the wall section 55. Running from the end wall 53, 55 is the longitudinal wall 61 extending through the entire length of the unit, preferably along the longitudinal center line thereof, although it could be set slightly to one side or the other of the center line if desired. Small transverse wall sections 63 extend laterally from opposite sides of the longitudinal wall 61, at the same distance horizontally from the rear or corridor walls 53 and 55 as the distance that the wall 43 is spaced horizontally from the corridor walls 23 and 25 in the A unit illustrated in FIG. 1. As mentioned in connection with unit A, this distance is preferably about 10 feet, but whatever the distance may be in unit A, the same distance is used in unit B for spacing the transverse walls or partitions 63 from the corridor walls 53 and 55.

At the outer end or outside wall end of the unit B, there is the outer wall 65 rising vertically from the floor slab through almost but not quite the full height of the story, say through a distance of 7 feet. This end wall then extends inwardly obliquely through a short distance, as at 66, and then vertically upwardly again at 67, to the full height of the story, terminating in the same horizontal plane as the wall sections 53, 55, 61, and 63. As above stated in connection with the description of unit A, the upper edges of the walls will be preferably at about 8 feet or 8½ feet above the floor slab, the two units A and B having the same height. The distance that the wall sections 67 are set inwardly from the extreme outer end of unit B is the same as the distance by which the reinforcing beams 47 are set inwardly from the extreme outer end of unit A, so that the distance from the corridor walls 53, 55 to the wall section 67 in unit B, is the same as the distance from the corridor walls 23, 25 to the reinforcing beams 47 in unit A.

In unit B, there are short side walls 69, extending from the outer end wall 65 along the side edges of the floor slab a short distance toward the opposite or corridor end of the unit, as illustrated. These walls are of the full height of the story, but extend in a horizontal direction only the same distance as the wall section 45 in unit A, which distance, as above stated, is preferably about 1 foot. The rest of the side edges of unit B, on both sides thereof, is completely open and unobstructed, as seen in FIG. 2.

Depending upon the floor plan desired in the final building, the longitudinal wall 61 may or may not have door openings therethrough. One such door opening is illustrated at 70, in the portion of the wall 61 which is between the transverse wall 63 and the corridor end of the unit.

Like unit A, this unit B is constructed as a single integral unit of reinforced concrete or the like. Just as is the case in unit A, unit B is very strong and relatively light. In cross section, both units A and B have the shape of an inverted letter T, the floor slab constituting the cross bar of the T, and the longitudinal partition 41 or 61 constituting the vertical bar thereof. Such a shape has great strength against flexure, so that during handling, transportation, and erection if it happens to be supported for a time merely at the corners, or merely at some intermediate point, it will not flex to a damaging extent. The walls 23, 25, and 31 at the corridor end of unit A, and the walls 53 and 55 at the corridor end of unit B, give added strength against lateral displacement or tilting of the central longitudinal wall relative to the floor slab, at the corridor end of the unit. Similarly, the wall 45 and beams 47 in unit A, and the wall portions 65, 66, 67 and 69 in unit B, give lateral stability to the longitudinal wall at the outer end of each unit. At an intermediate point of the length of the longitudinal wall, great lateral stability is given in unit A by the transverse wall 43 which extends all the way to the lateral edges of the unit. Also lateral stability of the intermediate portion of the longitudinal wall is given in unit B by the transverse wall sections 63. Even though these wall sections 63 are relatively short and do not extend all the way to the edges of the floor panel (preferably extending only about 2 feet or 2½ feet from the longitudinal wall 61) nevertheless they strengthen the longitudinal wall very substantially at this point.

Unit B may have, if desired, the same looped reinforcing bars rising above the top edges of various walls, or lifting loops in recesses in the floor, as described in connection with unit A, so that hooks of cranes or hoists may engage these loops to lift the unit onto or off of transportation vehicles or to erect the unit into the final building structure.

In assembling the units to make a habitable building, A units and B units are preferably assembled in side by side relation to each other, so that each of the main rooms or living spaces is formed partly in an A unit and partly in a B unit. This will be further described below, in connection with examples of possible floor plans. However, before going into details of floor plans, it is desired to continue the description of various forms of modular units.

Figure 3:
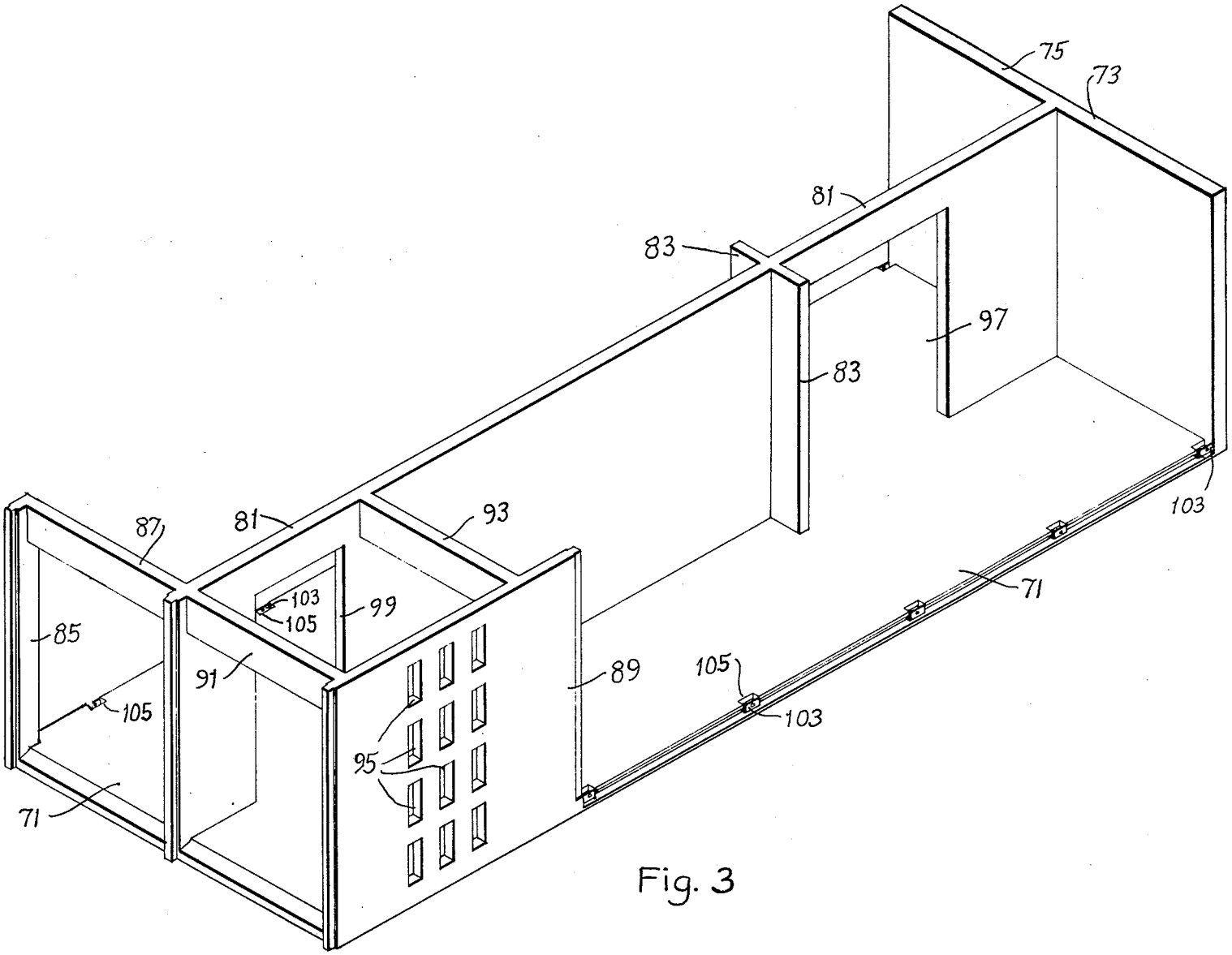
FIG. 3 is a similar view of another form of unit identified as unit C.

Referring now to FIG. 3, there is illustrated in somewhat simplified schematic form a modular unit which may be referred to as unit C. It is similar in many respects to unit B just described above (FIG. 2) but is longer and has some other differences. The floor slab, here indicated at 71, has preferably the same width already mentioned in connection with units A and B, namely, a width of about 12 feet. But the length is greater, preferably being about 33 feet.

Just as in the case of unit B, the walls 73 and 75 rise from the rear or corridor end of the floor slab, corresponding to the walls 53 and 55 in FIG. 2. One or the other of these walls 73 and 75 may have a doorway opening for access into the hall or corridor, or there may be no door in these walls, depending on the floor plan desired. No such door is shown in FIG. 3.

The longitudinal wall 81 extends from the walls 73, 75 along the longitudinal center line of the floor slab 71, just as in the case of the wall 61 in FIG. 2, all the way to the front end of this unit. There is also a short transverse wall 83 corresponding to the transverse wall 63 in FIG. 2, and at the same distance from the corridor walls 73, 75 as the distance of the wall 63 from the corridor walls 53, 55 in FIG. 2.

At the outer end or front end of the unit, the construction is more similar to that used in unit A (FIG. 1) than it is to unit B (FIG. 2). That is, instead of having a solid wall at the outer end, like the wall 65 in FIG. 2, there are two large openings, on either side of the central longitudinal wall 81, as plainly seen in FIG. 3, into which openings window frames may be set, or a window frame may be set into the left hand opening (viewed as in FIG. 3) while a railing may be set in the right hand opening, if the area to the right of the central wall 81 is to be used as a porch or balcony. A partial side wall 85 rises from one lateral edge of the floor panel and extends rearwardly along the edge for a limited distance, say about 1 foot. It corresponds to one of the short lateral walls 45 in FIG. 1 or one of the short lateral walls 69 in FIG. 2, except that it is at a greater distance from the corridor end of the unit than is the case in FIGS. 1 and 2, on account of this unit C being longer than units A and B. The top portion of the wall 85 is anchored to the central or longitudinal wall 81 by the stiffening or strengthening beam 87, corresponding to the beam 47 in FIG. 1, this beam preferably being set inwardly from the extreme outer end of the unit through a distance of about 6 inches, just as in the case of the beam 47 in FIG. 1.

On the other lateral edge of the floor slab is another partial wall, shown at 89. This wall 89 preferably extends a greater horizontal distance along its edge of the floor slab, toward the corridor end of the unit, than the wall 85, extending for example through a distance of about 9 or 10 feet, instead of only about 1 foot as in the case of the wall 85. The upper part of this wall 89 is tied to the central longitudinal wall 81 by two strengthening or stiffening beams 91 and 93 as shown. The beam 91 is preferably set inwardly a short distance, just a few inches, from the extreme outer end of the unit, and is in alignment with the beam 87. The beam 93 is set considerably further inwardly, say about 6 feet inwardly from the beam 91. Preferably the beam or strut 93 is at the same distance from its corridor wall 73, as the distance of the beam 47 from its corridor wall 23 in unit A, FIG. 1.

The wall 89 may have one or more openings therein, for decorative purposes, or for light admitting purposes. In some embodiments, a single large opening may be used, into which a window frame is fitted. In other embodiments, particularly where the space just inside the wall 89 is to be used as a balcony or small porch, a series of small openings may be used as indicated at 95, both to enhance the appearance and to admit more light to the balcony area and to permit persons occupying the balcony area to see the view in the direction through the wall 89. When used in connection with a balcony, these openings 95 need not be glazed. They may be arranged in any desired pattern; in the form here illustrated, there are four horizontal rows of openings 95, each row containing three rectangular openings.

The central longitudinal wall 81 may have one or more doorway openings, wherever desired according to the floor plan which is chosen. In FIG. 3, there is one doorway opening 97 in the rear portion of the wall 81, between the cross wall 83 and the corridor walls. There is also another door opening 99 in that portion of the central wall 81 which is forwardly beyond the strut or beam 93.

Like the other units previously described, this unit C is a single integral rigid structure formed of reinforced concrete or the like, the walls extending through the full height of the story, as before. Also as in the other units, the central wall 81 may have lifting loops projecting upwardly from its upper edge, with corresponding recesses in the bottom surface of the floor slab, and loops in the floor.

FIG. 3 shows anchoring members 103 in the form of angular pieces of strong metal each having a short vertical leg with a bolt hole therein, and a longer horizontal leg buried in and firmly anchored in the thickness of the floor slab 71. These anchoring members 103 are arranged at suitable intervals, every 5 or 6 feet, along each lateral edge of the floor slab, and opposite each one is a notch 105 to enable access to a bolt extending through the bolt hole in the verticle leg of the anchoring member and through the bolt hole in the similar leg of a similar anchoring member in the next unit placed along side the unit in question. In this way, the floor slab of one unit is bolted solidly to the floor slab of the next adjacent unit. When this has been done, the notches 105 are filled in with cement or concrete. Similar anchoring means are preferably used along the lateral edges of all of the modular units, but are not shown except in FIG. 3, for the sake of simplicity of the drawings.

In FIG. 3, unit C has been illustrated as having a short partial wall 85 on the left hand edge (viewed as in FIG. 3) of the unit, and the somewhat longer partial wall 89 on the right hand edge. Of course this may be reversed, and is reversed to accomplish certain floor plans, as further explained below; that is, the longer partial wall 89 with the openings 95 therein may extend along the left lateral edge of the unit (viewing the unit as in FIG. 3) and the shorter partial wall 85 may extend along the right hand lateral edge.

Figure 4:
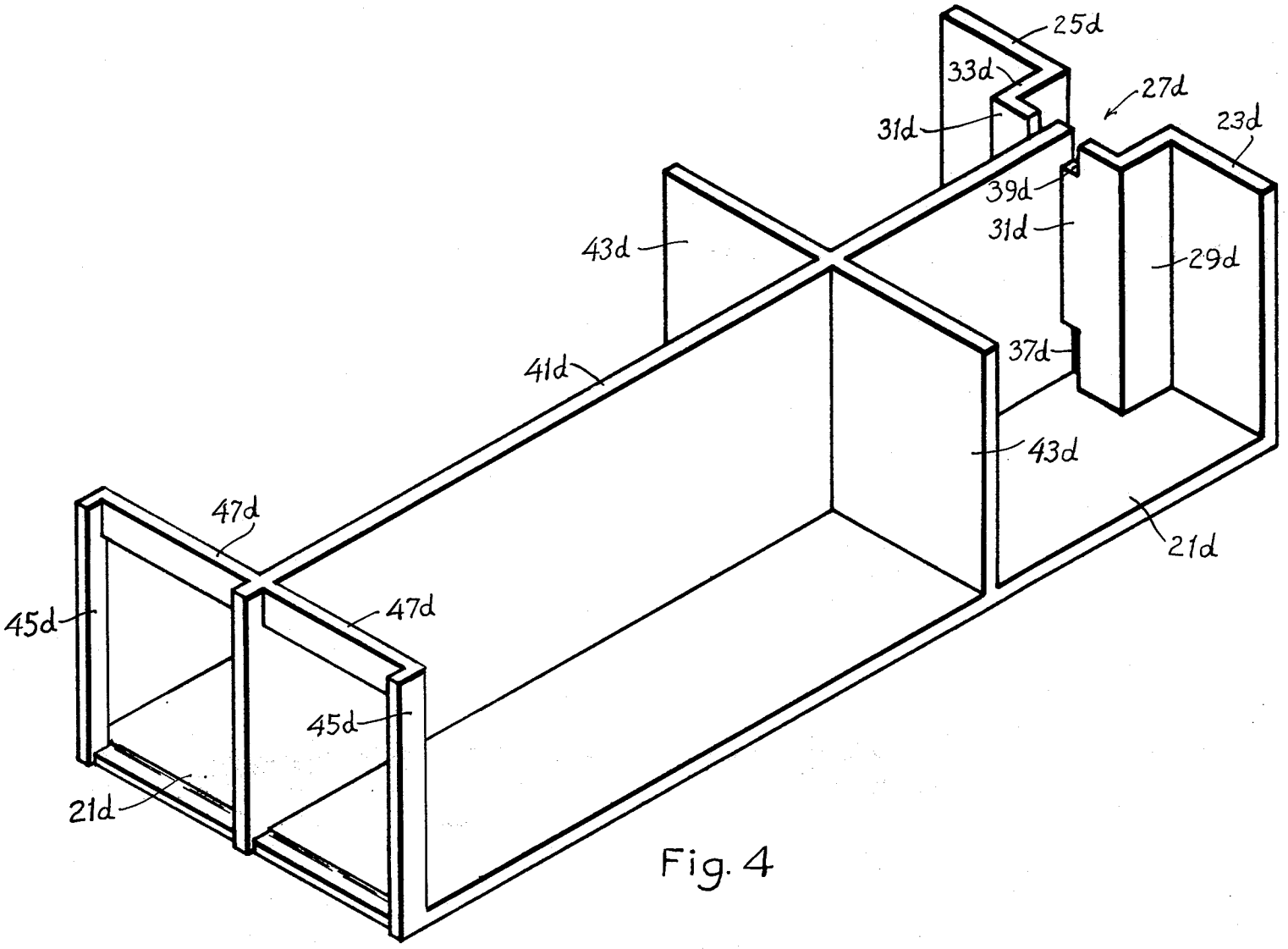
FIG. 4 is a similar view of still another form of unit identified as unit D.

Referring now to FIG. 4, there is shown another modular unit which may be referred to as unit D. This may be exactly the same as unit A above described in connection with FIG. 1, except that it is longer, having the length above described for unit C (FIG. 3) instead of the shorter length above described for units A and B (FIGS. 1 and 2). For the sake of simplicity, FIG. 4 identifies the various parts of the structure by the same reference numerals used in connection with FIG. 1, with the addition of the letter "*d*" to each numeral. The transverse wall 43d preferably remains in the same relative location to the corridor walls **23*d* and 25*d* as in FIG. 1, the added length of unit D being added between the wall 43*d* and the outer end of the unit, rather than between the wall 43*d*** and the corridor.

Figure 5:
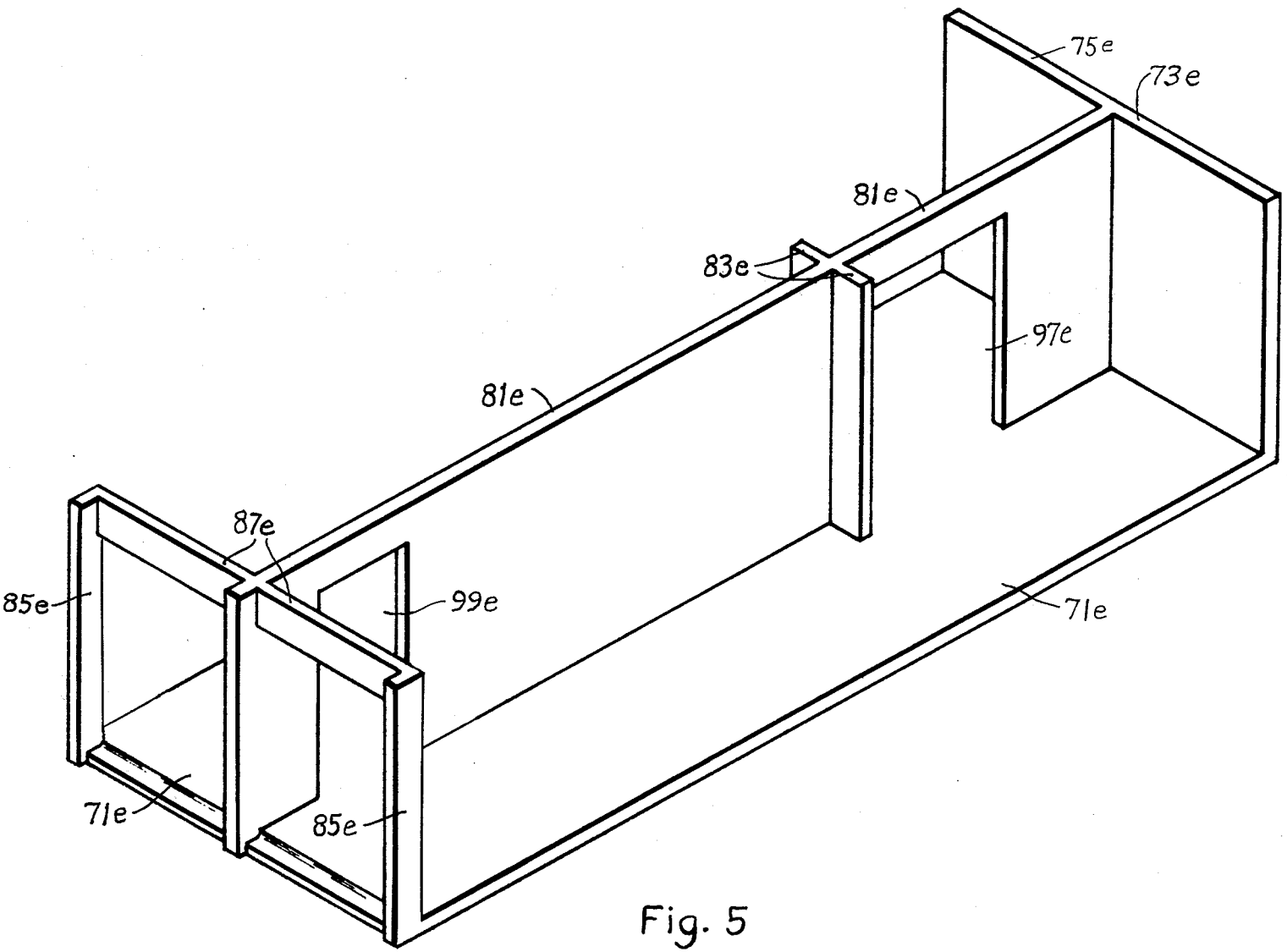
FIG. 5 is a similar view of a unit identified as unit C2, constituting a modification of the unit C shown in FIG. 3.

Finally, in FIG. 5 there is shown a variation of unit C (FIG. 3) and this variant unit may be called unit C2. This may be exactly the same as unit C (FIG. 3) except that the short partial wall, like the wall 85 in FIG. 3, is used on both lateral edges of the unit, there being no longer lateral wall like the wall 89 in FIG. 3. Everything else in this unit C2 may be the same as in unit C, and corresponding parts are identified by the same reference numerals used in FIG. 3 with the addition of the letter "*e*" to each numeral.

As already mentioned, modular units according to the present invention are assembled side by side on a suitable foundation separately prepared, to form a habitable building according to various desired floor plans. In a building of more than one story, the ceiling of each story is provided by the underside of the floor slab of the unit resting on top of it. A separate ceiling panel or slab is provided for the ceiling of the top story, and such ceiling panel may provide the roof for the building, or there may be a separate roof structure erected over it. The modular units formed as above described do not provide the floor portions for the corridors, nor the stair units, nor elevator shafts, nor other special features, all of which may be either built at the site, or built at the factory as separate modular units and transported to the site. However, the units may have the floor slabs extended to provide floors for the corridors, as further described below. In any event, there is a great saving in expense and convenience and speed of construction, by using the modular units do constitute the main part of the building structure, even though some supplementary construction at the site may be needed.

Figure 6:
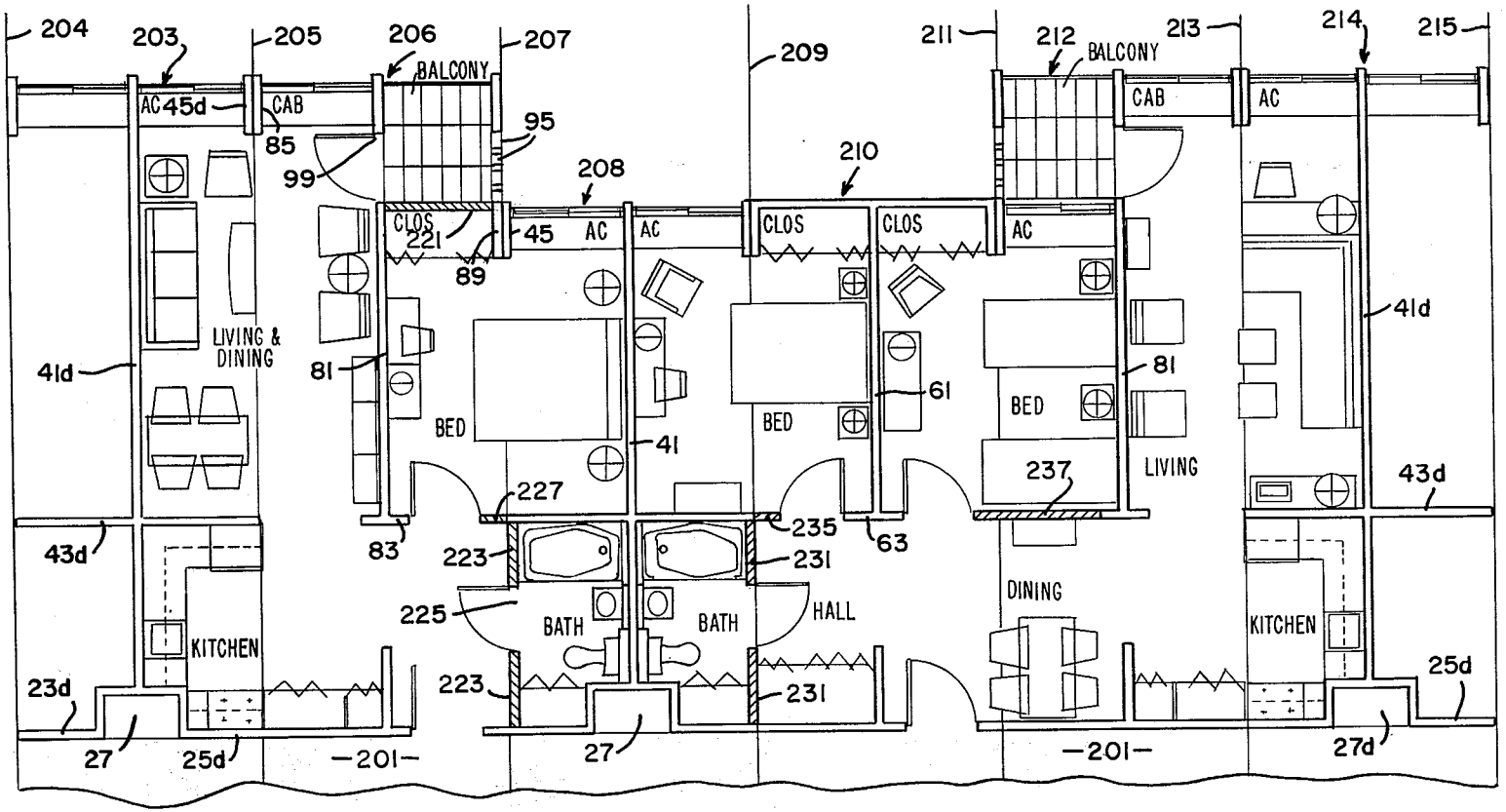
FIG. 6 is a fragmentary schematic floor plan of a portion of an apartment building, showing how various units may be combined to provide both one bedroom and two bedroom apartments.

Referring now to FIG. 6, there is shown a floor plan of a portion of an apartment building, illustrating how the modular units of the present invention may be combined to provide some apartments having one bedroom and other apartments having two bedrooms. A hallway or corridor is indicated schematically at 201. The modular units are all shown as being on one side of this corridor, the upper side as illustrated in FIG. 6, but of course in practice there would be other units faced oppositely, on the opposite or lower side of the corridor.

In this floor plan of FIG. 6, various pieces of equipment such as plumbing fixtures and kitchen appliances are shown by conventional symbols readily understood by those familiar with architectural drawings, so they need not be specifically described in detail nor identified by individual reference numerals. Likewise various articles of furniture such as beds, chairs, tables, etc., are indicated in suitable locations by conventional symbols, but of course the furniture, being movable, can be placed wherever desired.

Starting at the left hand edge of FIG. 6, the first modular unit 203 extends from the reference line 204 to the reference line 205. Next to it, on the right, is the modular unit indicated in general at 206, extending from the reference line 205 to the reference line 207. Next comes the modular unit indicated at 208, extending from the reference line 207 to the reference line 209, and next to it is the modular unit 210 extending from the line 209 to the reference line 211. Then comes the modular unit 212 extending from the line 211 to the line 213, and beyond that is the modular unit 214 extending from the reference line 213 to the reference line 215. The same arrangement may be repeated as far as desired, to right or left of the units shown in FIG. 6.

The unit 203 is a unit D, shown in FIG. 4. The next unit 206 is a unit C as shown in FIG. 3, but with the partial lateral walls 85 and 89 reversed. The next unit 208 is a unit A as in FIG. 1. The next unit 210 is a unit B as in FIG. 2. The next unit 212 is a unit C, with the partial walls 85 and 87 in the same relative position illustrated in FIG. 3, rather than being reversed as were these walls in the unit 206. Next beyond the unit 212, unit 214 is a unit D, as in FIG. 4.

From studying the floor plan, FIG. 6, it will be seen that the right hand half of unit 203 plus all of unit 206 plus the left hand half of unit 208 combined to constitute one apartment having a single bedroom, a living and dining room, a balcony, a kitchen, and a bathroom. The kitchen is formed in the alcove at the corridor end of the right hand half of unit 203, which is a unit D as above stated. The living room is formed partly by the forward part of the right hand half of unit 203, and partly by the left hand half of the forward part of unit 206. The outer face of the partial wall **45*d* of unit 203 lies flat against the outer face of the partial wall 85 of unit 206, forming a strong support of double thickness adequate to carry heavy loads of other stories above this particular story. The door 99 through the central wall 81 of unit 206** gives access to an attractive balcony.

The bedroom of this first apartment is formed partly by the right hand half of unit 206, and partly by the left hand half of unit 208. The left hand face of the wall 45 of unit 208 fits tightly against the right hand face of the rear portion of the wall 89 of unit 206 (that is, the portion thereof to the rear of the openings 95). As in the case of the junction between the units 203 and 206, these two walls together form a wall of double thickness adequate to support considerable weight above it. Wherever walls abut like this, they may be fastened together by any suitable means, including tie bolts or clamps or simply be cemented together when they abut against each other. The bathroom of this first apartment is formed in the alcove in the left hand side at the rear end or corridor end of unit 208. It will be noted that this is a complete bathroom, comprising a water closet, washbasin, and tub, and all of these plumbing fixtures can be installed at the factory where the modular unit is made, as above mentioned. Suitable service pipes or conduits in the vertical utility shaftway 27, installed at the factory or subsequently at the time of erection, have branches going to the piping installed at the factory for the various fixtures and running approximately horizontally, with slight slope where necessary, along or within the respective walls to the utility shaftway. Similarly, the utility connections for the kitchen equipment rise through the utility shaftway *27d* in the unit 203, and are branched off to the kitchen equipment at each floor of the building.

The next apartment is a two bedroom apartment and extends from the central longitudinal partition of unit 208 to the central longitudinal partition of unit 214. The bathroom of this second apartment is formed in the alcove at the rear end of the right hand half of unit 208, and is a reversed duplicate of the bathroom of the first apartment formed on the opposite side of the central wall of this unit.

The first bedroom of this two bedroom apartment is formed from the right hand half of unit 208 and the left hand half of unit 210, as plainly seen in FIG. 6. The second bedroom is formed from the right hand half of unit 210 and the left hand half of unit 212. An entrance hall is formed across the entire width of unit 210, rearwardly (toward the corridor) from the bedrooms, merging into a dining room in the left hand half of unit 212. The kitchen is in the alcove in the left hand half of unit 214. Forwardly of the kitchen and dining room, a large living room is formed from the right hand half of unit 212 and the left hand half of unit 214, this living room having a door opening onto the balcony formed at the forward left corner of unit 212.

It is noted that the shorter lengths of unit 208 and 210 (which constitute an A unit and a B unit, respectively) combine very well with the longer lengths of units 203, 206, 212, and 214, providing an attractive front wall of the apartment building, having recesses or alcoves giving it a more attractive appearance than a single straight wall without angles. The various kinds of units already described may be combined in various ways, not necessarily in the exact way shown in FIG. 6, to provide various apartment arrangements.

Supplementary partitions, in addition to those initially formed integrally with the unit at the factory where the unit is made, may be installed at the site, where necessary. For example, in unit 206 a partition 221 has been installed (for example extending straight downwardly from the strengthening beam or strut like the beam 93 in FIG. 3) to separate the balcony from the bedroom, and a closet may be installed just to the rear of this partition 221. In this same apartment, a partition 223 may be installed to separate the bathroom from the entrance hallway, this partition having a suitable bathroom door 225. Likewise, a partition 227 may be installed in line with the partial cross partition 83 of unit 206, to form the rear wall of the bedroom.

Similarly, in the next apartment to the right, a partition 231, having a suitable door therein, separates the bathroom from the entrance hallway, and a partition 235 in conjunction with the partial transverse partition 63 forms part of the rear wall of the first bedroom. A partition 237, partly in the unit 210 and mainly in the unit 212, in alignment with the partial wall 83 thereof, forms the rear wall for the second bedroom. Partitions of this kind are easily erected at the site when the building is assembled, and may be put in or omitted, depending upon the floor plan desired. For example, the kitchen alcove in each instance is similar to (or a reverse duplicate of) the bathroom alcove, but ordinarily does not need any partition to separate it from adjoining space, whereas the bathroom should, of course, be separated from the adjoining space by a partition such as 223 or 231. Similarly, where a space to one side of the central longitudinal partition is to be used as a living room, as in the case of the right hand half of unit 212, no partition extending the transverse wall 83 is needed. But where such space is to be used as a bedroom, as in the case of the left hand side of the unit 212, the supplementary partition 237 is needed. Thus it is best that the permanent integral partitions or walls be confined to the positions already described in the detailed description of the various modular units, and that supplementary walls or partitions be erected where needed, at the site, when it is decided exactly what floor plan is desired by the person who is to occupy the apartment. The basic units as described in connection with FIGS. 1–5 thus have great flexibility in use, and may be easily adapted to various different floor plans by installing additional or supplementary partitions where desired, usually in alignment with and joined to the integral walls provided as part of the factory-built modular unit.

FIG. 7 illustrates the use of modular units according to the present invention for constructing a hotel or motel, where no cooking facilities are needed. Such a building may be constructed by using units A and B, alternating with each other. The corridor is indicated at 251. Ordinarily, modular units would extend from both sides of the corridor, but only units on one side are here shown. The first modular unit, extending from the reference line 253 to the reference line 254, is indicated in general at 255. The second modular unit, extending from the reference line 254 to the reference line 256, is indicated at 257.

The unit 255 may be a unit B, the same as shown in FIG. 2 except for omission of the doorway 70, the wall 61 being continuous or unbroken. Also, a second doorway opening is provided in the portion 53 of the corridor wall, for access to the other side of the partition 61, since this partition divides one of the room units from the next room unit. The unit 257 in FIG. 7 is unit A shown in FIG. 1.

With this arrangement, the room unit here illustrated (one room and bath, with no cooking facilities) is formed from the right hand half of unit 255 and the left hand half of unit 257, the bathroom being formed in the alcove behind the transverse wall 43 of unit 257. A supplementary partition 261 is erected along the dividing line 254 between unit 255 and unit 257, from the transverse wall 43 to the corridor wall, to close the bathroom off from the rest of the space, this partition having a suitable door, of course. The next guest room to the right of the room shown in FIG. 7 is a reverse duplicate of the room shown, the bathroom being on the left side of the room. The next guest room to the left of the room shown is again a reverse duplicate. If it is desired to furnish the guest room in pairs with an access door between them so that two rooms may be rented together to a family, then the above mentioned doorway 70 in the central partition 61 is allowed to remain, and a suitable door is provided. But if this particular hotel or motel does not sesire to have connecting rooms, then the wall 61 is made continuous, as already mentioned, with no doorway therein.

A closet may be formed on each side of the central longitudinal wall 61 at the forward end or outer wall end of the unit 255, being formed for example by a folding partition as indicated schematically. The depth of the closet may be equal to the horizontal length of the partial side wall 69 of the unit.

If somewhat larger guest rooms are wanted for the motel or hotel, then instead of using a unit A in the location 257 and a unit B in the location 255, one would use the larger size unit D (FIG. 4) in the location 257, and the larger unit C2 (FIG. 5) in the location 255. The arrangement would be the same as illustrated in FIG. 7 except that the rooms would be larger in a direction perpendicular to the corridor, although of the same width.

The open sides of the various utility shaftways which face toward the corridor are, of course, closed off by inserting hinged doors or removable panels, when the building is completed. Should any difficulty be encountered later with the water supply, soil pipes, or electric conduits, these doors can be opened (or the panels can be removed) for easy access to the utility shaftways, which shaftways are of sufficiently ample size to allow easy access for repair of all the pipes and conduits in the shaftway, without the difficulties encountered in the familiar cramped quarters so often provided.

When a building of more than one story is erected, the units are stacked in vertical alignment with each other, a unit A being on top of another unit A, a unit B being on top of another unit B, and so on. Thus the utility shaftway formed at the corridor end of each unit A or unit D is aligned with the utility shaftway of the next higher and next lower units, so that there is a continuous utility shaftway extending unbroken from top to bottom of the building, in the location of each unit A or unit D. The various vertical pipes and conduits may then be easily installed in these shaftways, with branches to connect with the previously installed piping associated with each bathroom or kitchen area, the factory installed piping terminating at ends which project slightly into the shaftway of the unit, ready for quick and easy attachment to the branches of the vertical piping which is installed in the shaftway at the building site. Alternatively, the vertical piping also may be pre-installed at the factory in short sections of only one story in height, using quick connecting means for connecting the top of one pipe to the bottom of the aligned pipe immediately above it.

If the various modular units are constructed in the form shown in FIGS. 1–5, the modular units do not provide floors for the adjacent corridors, and the floors of the corridors are formed separately. However, it is possible, according to the present invention, to modify the modular units so that they provide corridor floors. Referring to FIG. 8, which is a fragmentary schematic plan, there is shown a fragment of a building where modular units are arranged on opposite sides of a corridor which is indicated in general at 301. On one side of the corridor, an A unit is shown at 302, followed by a modified B unit 303, then another A unit 304, and another modified B unit 305, and so on. On the opposite side of the corridor, similar units are arranged in alternating relation with a modified B unit 312 directly across the corridor from the A unit 302, then an A unit 313 directly across from the modified B unit 303, followed by another modified B unit 314 across the corridor from unit 304, and an A unit 315 across the corridor from the unit 305, and so on.

These A and B units may be of the kind and shape above described, except that the modified B units have their floor slabs extended to form the corridor. Thus the modified B unit 312 has an extended floor slab portion 312a which projects beyond the corridor wall, across the width of the corridor, to the wall of the unit 302 which is opposite the unit 312. The unit 303 has an extended floor slab portion **303*a* which extends across the corridor to the edge of the unit 313, forming the floor of this portion of the corridor. The same is true of modified B unit 314 which has a floor slab extension 314*a*, and the unit 305 has a floor slab extension 305*a***, and so on.

In each case, the extended floor slab portion fits into a suitable ledge or recess or rabbet formed in the unit directly across the corridor. Thus the extended portion or corridor portion of the floor slab is supported in part by cantilever action, being integral with the main portion of the floor slab, and is supported in part by its extreme end interfitting with the companion unit directly across the corridor. These floor slab extensions to form the corridor floors can be formed on either the A units or the B units (similarly as to the C units and D units) if desired, but it is preferred to form them usually on the B units (or C units) because the B and C units do not have the shaftway recesses. Therefore, the corridor floor extensions are somewhat stronger since they are rigidly and integrally connected to the rest of the units throughout the entire width of the unit, rather than having the connection interrupted by an opening for the utility shaftway.

FIG. 8, in conjunction with FIG. 9, also illustrates another possible modification of the construction. As above mentioned, each modular unit preferably has a width of about 12 feet, and this is about the maximum width which can be used as a practical matter, in view of width limitations in transporting the finished units from the factory to the erection site, by railroad car or by highway truck. In fact, in some localities it may be necessary to make the modular units less than 12 feet in width, say for example 10 feet.

With two modular units placed directly side by side in abutting relation to each other, assuming that the longitudinal wall of each unit extends along the center line thereof, it is seen that the maximum room width (half of the room being in one unit and the other half in the adjacent unit) would be 12 feet less the thickness of the longitudinal wall, if each unit were 12 feet in width. But some hotels, motels, or apartment buildings want rooms a little wider than this. Therefore, according to the present invention it is possible to erect the modular units so that adjacent units are not tight against each other but are slightly spaced from each other by the required additional distance to give the additional width to the rooms, and the space between them is filled with a pre-formed unit of the required width.

This is illustrated in FIGS. 8 and 9, where the above described units 304 and 305 are laterally separated from each other (the same being true of the units 314 and 315) and the supplementary floor slab 324 is placed between them, having edges which rest on ledges of the floor slabs of the units 304 and 305, as illustrated in FIG. 9. The supplementary floor slab unit may have a width of, say 2 feet, which would give a room size of 14 feet less the thickness of the longitudinal wall, if each unit has a width of 12 feet and if the longitudinal walls are on the center lines of the unit. Of course the supplementary floor slab unit 324 can be made narrower or wider, depending upon the width desired for the rooms and upon the width of the regular modular units with which it is used.

At the ends of the floor slab unit there may be rigid integral walls aligned with the corresponding walls of the regular modular units 304 and 305 with which the supplementary unit is used. Also, the supplementary unit may be extended as at 324*a* to form that part of the floor of the corridor which is opposite this supplementary unit, either throughout the full width of the corridor or, if desired, through one-half the width of the corridor, the other half of the width of the corridor floor being formed by a similar extension on a similar supplementary floor unit on the other side of the corridor.

It is within the scope of the invention to use special units at the end of the entire building, to form portions of the end rooms. For example, if a row of rooms is formed along a corridor by units of the kind above described, then at each end of the building there would be a modified unit in the form of approximately one-half of a regular unit, so that the longitudinal wall thereof would from the outer wall at the end of the building. In other words, the end units would be similar to a regular modular unit with the floor slab and the end wall and transverse wall portions sliced off on one side of the longitudinal wall.

It is also possible to arrange the units in various other forms rather than necessarily along opposite sides of a straight corridor. For example, the units may project from four sides of a square or rectangular central court or hallway, so that some units are at right angles (or other appropriate angles) to each other.

It has been mentioned above that the partial side walls at the outer ends of the lateral edges of the modular units, as shown at 45 (FIG. 1), 45d (FIG. 4), 69 (FIG. 2), 85 (FIG. 3), and 85e (FIG. 5) may extend along their respective lateral edges through a horizontal distance of about 1 foot. Of course this dimension, like all other dimensions given herein, is merely an example and is not intended to be limiting or critical. However, it may be mentioned that it is sometimes desired to make these lateral walls somewhat longer in a horizontal direction, extending for example through a horizontal distance of about 3 feet, the space between these lateral walls and the central longitudinal wall then being used for a storage closet or the like, or for air conditioners or other equipment. Such an arrangement is shown in the floor plans, FIGS. 6 and 7, where the lateral walls are shown as being longer (in a horizontal direction) than in the individual modular unit views shown in FIGS. 1–5. These short lateral walls can be eliminated entirely, if preferred, although ordinarily it is desired to have at least a short lateral wall (say about one foot in length along the edge of the unit) to provide an anchoring support for window frames or the like, and to provide additional support for the outer corners of the floor slab of the next modular unit above the one in question.

What is claimed is:

1. A habitable building structure comprising a series of separate living areas intended for occupancy by different persons, said living areas being formed at least mainly from a series of separate modular units assembled in side by side relation to each other, said modular units being of a plurality of different kinds, at least some of said modular units each having a rigid floor slab portion and a corridor wall portion rising from and formed integrally with the floor slab portion, adjacent modular units being assembled with their respective corridor wall portions in alignment with each other and with the respective side edges of the floor slab portions substantially engaging each other, the respective modular units extending from a composite corridor wall in a direction perpendicular to such corridor wall to an outer end arranged generally parallel to said corridor wall, at least some of said modular units having an approximately central wall portion rising from and formed integrally with the floor slab portion of that unit and extending from said corridor wall to said outer end in a position set materially inwardly from both lateral edges of that modular unit so that a substantial part of the floor area of that modular unit lies on each side of said central wall portion, each of said separate living areas being formed in part from that portion of one modular unit lying on one side of its central wall portion and that portion of an adjacent modular unit lying on the adjacent side of its central wall portion, a series of said modular units being assembled in a row on one side of a corridor, another series of modular units being assembled in a second row on the opposite side of the same corridor, the floor slab portions of certain of said modular units being extended in cantilever fashion beyond the respective corridor wall portions thereof to form portions of the floor of the corridor.

* * * * *